US006745655B2

(12) United States Patent
Abt et al.

(10) Patent No.: US 6,745,655 B2
(45) Date of Patent: Jun. 8, 2004

(54) SYSTEM FOR STACKING BLANKS PRODUCED PARTICULARLY IN A PROGRESSIVE DIE PROCESS

(75) Inventors: Wilfried Abt, Rechberghausen (DE); Alfred Bareis, Uhingen (DE)

(73) Assignee: Schuler Pressen GmbH & Co., Goeppingen (DE)

( * ) Notice: Subject to any disclaimer, the term of this patent is extended or adjusted under 35 U.S.C. 154(b) by 0 days.

(21) Appl. No.: 10/005,871

(22) Filed: Dec. 7, 2001

(65) Prior Publication Data

US 2002/0104415 A1 Aug. 8, 2002

(30) Foreign Application Priority Data

Jul. 12, 2000 (DE) ..... 100 60 833

(51) Int. Cl.[7] ..... B26D 7/06; B26D 7/18

(52) U.S. Cl. ..... 83/91; 83/111; 83/150

(58) Field of Search ..... 83/95, 91, 97, 83/90, 89, 167, 414, 84, 85, 86, 87, 508, 111, 150

(56) References Cited

U.S. PATENT DOCUMENTS 4,046,264 A * 9/1977 Bergmann et al. ..... 414/27
4,108,031 A * 8/1978 Dangelmaier et al. ..... 83/90
4,110,895 A * 9/1978 Mitsui ..... 29/564.2
4,111,086 A * 9/1978 Dangelmaier ..... 83/90
4,162,734 A 7/1979 Dangelmaier et al.
4,445,272 A * 5/1984 Bruhn et al. ..... 29/598
6,295,268 B1 * 9/2001 Nakamichi ..... 369/178.01
6,324,951 B1 * 12/2001 Wegener ..... 83/89
6,468,025 B1 * 10/2002 Stumpf et al. ..... 414/797
2002/0117033 A1 * 8/2002 Bender ..... 83/165

FOREIGN PATENT DOCUMENTS

DE 4308318 10/1994
FR 2289267 11/1975

* cited by examiner

*Primary Examiner*—Allan N. Shoap
*Assistant Examiner*—Ghassem Alie
(74) *Attorney, Agent, or Firm*—Crowell & Moring LLP

(57) ABSTRACT

System for stacking blanks produced, particularly in a progressive die process, has one or more stacking mandrels which can be lifted and/or lowered in a stacking channel. The stacking mandrel/mandrels has/have a stacking mandrel top part and a stacking mandrel bottom part. At least one metal sheet holder is arranged in the area of the stacking mandrel top part. The stacking bottom part has a rotatable construction.

10 Claims, 1 Drawing Sheet

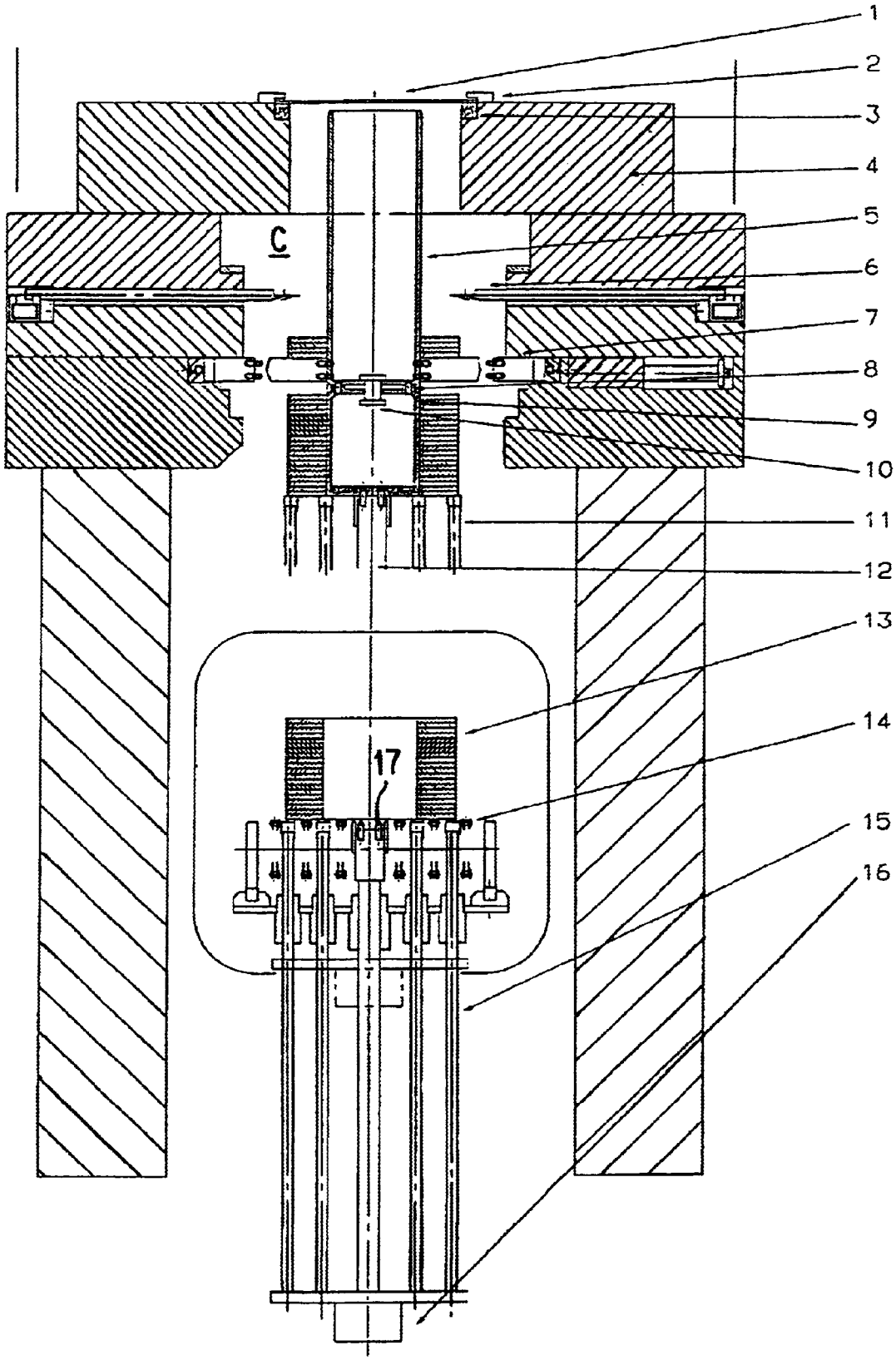
1
2
3
4
5
6
7
8
9
10
11
12
13
14
15
16
17
C

SYSTEM FOR STACKING BLANKS PRODUCED PARTICULARLY IN A PROGRESSIVE DIE PROCESS

BACKGROUND THE INVENTION

This application claims the priority of German Patent Document 100 60 833.7, filed in Germany, Dec. 7, 2000, the disclosure of which is expressly incorporated by reference herein.

The invention relates to a system for stacking blanks produced particularly in a progressive die process.

DD 117369 describes a known system in which the stampings are stacked in a stacking channel perpendicular through the die plate of a cutting tool onto a stacking mandrel. The stacking mandrel is arranged on a transport carriage and can be coaxially connected with a guiding mandrel which reaches into the stacking channel. The guiding mandrel is equipped with a holding device for the purpose of forming an intermediate stack. The holding device, when engaged, permits the transfer of the finished stack from the guiding mandrel onto the stacking mandrel of the guiding carriage.

Further, DE 2605983 describes a system for the stacking-image-conforming stacking of stampings produced in the progressive die process. The stampings can be stacked in a stacking channel perpendicular through the bottom die of a cutting tool onto a stacking mandrel. The stacking mandrel is provided with a coaxially arranged guiding mandrel, which is held during the formation of an intermediate stack, in which case the guiding mandrel has a holding device for the intermediate stack formation. The guiding mandrel is constructed as a mandrel point which is smaller than the stacking mandrel and which, by way of the holding device arranged inside the stacking channel, is held during the stack exchange. During the stack exchange, the stacking mandrel, separated from the mandrel point, can be lowered below the removal plane of the stacks.

Likewise, a process is known from DE 430818 for producing metal sheet stacks from stamped metal sheets. The metal sheet stacks are loosely lined up to form rods. The stamped metal sheets are provided with an axle bore and additional openings as well as an outer circumference which are symmetrically designed at an angular pitch extending in a circular manner at an integral angular pitch number. The stamped metal sheets in each case forming the stack, after the addition of one additional metal sheet respectively, are rotated by an angular pitch. When the maximal piece number is reached, the stack as a whole is pushed along by the stack height.

SUMMARY OF THE INVENTION

An object of the present invention is to provide a system for stacking blanks which fully automatically creates stacks which compensate for a possibly existing difference in metal sheet thicknesses.

This object has been achieved by a system for stacking blanks produced, particularly in the progressive die process, comprising at least one stacking mandrel which can be lifted and/or lowered in a stacking channel. The stacking mandrel has a stacking mandrel top part and a stacking mandrel bottom part, in the area of the stacking mandrel top part at least one metal sheet holder being arranged, and the stacking mandrel bottom part being constructed in a rotatable manner.

According to the invention, it is provided that at least one fixing element is arranged essentially in the area between the stacking mandrel top part underside and the stacking mandrel bottom part top side.

According to a further asset of the present invention, it is provided that the stacking mandrel top part underside has at least one holding element for connecting the stacking mandrel bottom part with the stacking mandrel top part.

In another further feature according to the invention, it is provided that, at least one mandrel holder element is arranged essentially in the area of the stacking mandrel top part and the stacking mandrel bottom part.

Furthermore, it is provided according to the invention that the mandrel holder element is arranged in a slidable manner. In a still further development according to the invention, the metal sheet holder is arranged in a slidable manner.

In yet another further development according to the invention, the stacking mandrel bottom part is detachably connected with a lifting frame. Furthermore, a transport device is arranged essentially below the stacking mandrel bottom part.

In a still further development according to the invention, the lifting frame is arranged such that it penetrates the transport device and can be lowered in the latter. The lifting frame has at last one rotatable element.

BRIEF DESCRIPTION OF THE DRAWING

Other objects, advantages and novel features of the present invention will become apparent from the following detailed description of the invention when considered in conjunction with the accompanying drawing.

The sole FIGURE is a cross-sectional view of a stacking system with a rotatable stacking mandrel according to the present invention.

DETAILED DESCRIPTION OF THE DRAWING

A sheet metal material strip 1 is guided between a belt guide at a tool 2 and a die ring at the tool 3 which, in turn, are arranged at a tool bottom part 4.

A stacking mandrel top part 5 extends in the stacking channel C almost to the material strip 1 in the area of the tool bottom part 4. When a metal sheet is now separated out of the material strip 1, this metal sheet is lined up on the stacking mandrel top part 5. The individual metal sheet moves along this stacking mandrel top part 5 in the stacking channel in the direction of a stacking mandrel bottom part 9.

A movable metal sheet holder 6 is also arranged in the stacking channel in the area of the stacking mandrel top part 5. The metal sheet holder 6 is arranged in a movable manner so that, when the predetermined stack size has been reached, for example, after a defined number of machine downstrokes or the resulting number of individual metal sheets which come to rest upon one another in the area of the stacking mandrel bottom part 9, the metal sheet holder 6 is moved in the direction of the stacking mandrel in order to hold back blanks sliding down from above. Subsequently, a mandrel holder 7 is connected with the stacking mandrel top and bottom parts 5, 9 in order to hold the latter. As soon as the mandrel holder 7 is in the mandrel holding position, the metal sheet holder is withdrawn.

Subsequently, the fixing mandrel top/bottom part 8 is opened up between the mandrel top part 8 and the mandrel bottom part 9 and the stacking mandrel bottom part 9 is moved by a path defined by the holder for the mandrel bottom part 9 away from the stacking mandrel top part 5. As soon as the stacking mandrel bottom part 9 has a defined distance from the stacking mandrel top part 5, the rotating shaft 12 with the driving pin 17 will start to operate. The stacking mandrel bottom part 9, together with the partial stack consisting of the individual metal sheets so far deposited, is rotated by a previously adjusted angle around the holder 6 for the mandrel bottom part 9 by way of the rotating shaft 12 or the motor 16 situated on the rotating shaft 12. In this manner, sheet thickness irregularities are compensated in that metal sheets rolled, for example, in a wedge shape are deposited in a mutually rotated manner such that the wedge effect existing in the metal sheet is compensated.

During the rotational operation of the stacking mandrel bottom part 9, the metal sheets, which are continuously cut out, will, for the time being, collect on the mandrel holder 7. After the conclusion of the rotation of the stacking mandrel bottom part 9, the latter will be lifted again and firmly connected with the stacking mandrel top part 5 by the fixing of the mandrel top part and bottom part 8. The mandrel holder 7 will now move away again from the stacking mandrel. The individual metal sheets collected on the mandrel holder 7 slide into their deposited position on the previously rotated partial stack until these, so far, non-rotated metal sheets reach an also previously defined partial stack height and the above-described rotating operation of the stacking mandrel bottom part 9 will start again with the movement of the metal sheet holder 6. This stacking and rotating takes place until a certain number of partial stacks or individual metal sheets are situated on top of one another.

Thus, when the required stack height has been reached, the metal sheet holder 6 and subsequently the mandrel holder 7 will move toward the stacking mandrel top part 5 and intermediately dispose the permanently produced individual metal sheets on the mandrel holder 7. In this stack removal phase, the mandrel holder 7 is connected with the stacking mandrel 5, 9 or is guided toward the latter and is fixed by pins in order to hold the stacking mandrel 5,9. Meanwhile, the locking between the rotating shaft with the driving pin 12 and the stacking mandrel bottom part 9 is opened up and the lifting frame 11 is moved into the lowered position 15.

In this stack removal phase, the mandrel holder 7 is connected with the stacking mandrel 5,9 in order to hold the latter. The stacking mandrel bottom part 9 is connected with the stacking mandrel top part 5 by the holder 10 and the fixing of the mandrel top and bottom part 8 in order to move out of the stack during the stack removal by a downward movement of the stack. The stack with the rotated partial stacks 13 is lowered onto the transport chain/chain conveyor 14. In the process, the lowered lifting frame 15 disappears between the individual chains of the chain conveyor 14, on which the stack 13 comes to rests which was lowered with the rotated partial stacks. The stack 13, which was deposited in this manner, is moved by the chain conveyor 14 out of the press or the area of the tool bottom part. After the stack 13 has left the depositing area of the lowered lifting frame 15, the latter is lifted again and is fixed with the stacking mandrel bottom part 9 by the driving pins 17 arranged on the rotating shaft 12.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. System for stacking blanks producible in a progressive die process, comprising at least one stacking mandrel arranged to be at least one of lifted and lowered in a stacking channel by a lifting frame, wherein the at least one stacking mandrel has a stacking mandrel top part and a stacking mandrel bottom part, said staking mandrel bottom part is rotatable relative to the said stacking mandrel top part, and at least one metal sheet holder arranged in the area of the stacking mandrel top part, wherein the stacking mandrel bottom part is detachably connectable from said lifting frame.

2. The system according to claim 1, wherein the lifting frame has at least one rotatable element.

3. The system according to claim 2, wherein at least one fixing element is arranged substantially in an area between an underside of the at least one stacking mandrel top part and a side of the stacking mandrel bottom part top.

4. The system according to claim 3, wherein the stacking mandrel top part underside has at least one holding element for operatively connecting the stacking mandrel bottom part with the stacking mandrel top part.

5. The system according to claim 4, at least one mandrel holder element is arranged substantially in an area of the stacking mandrel top part and the stacking mandrel bottom part.

6. The system according to claim 5, wherein the mandrel holder element is displaceably arranged.

7. The system according to claim 6, wherein the at least one metal sheet holder is displaceably arranged.

8. The system according to claim 7, wherein a transport device is arranged substantially below the stacking mandrel bottom part.

9. The system according to claim 8, wherein the lifting frame is arranged to penetrate and be lowerable into the transport device.

10. System for stacking blanks producible in a progressive die process, comprising at least one stacking mandrel arranged to be at least one of lifted and lowered in a stacking channel by a lifting frame, wherein teat least one stacking mandrel has a stacking mandrel top part and a stacking mandrel bottom part, said staking mandrel bottom part is rotatable relative to the said stacking mandrel top part, and at least one metal sheet holder arranged in the area of the stacking mandrel top part, wherein a transport device is arranged substantially below the stacking mandrel bottom part, and said lifting frame is arranged to penetrate and be lowerable into the transport device.

* * * * *